US005954263A

United States Patent [19]

Posson

[11] Patent Number: 5,954,263

[45] Date of Patent: Sep. 21, 1999

[54] LIQUID-TIGHT BOAT-SHAPED PACKAGING TRAY AND ITS MANUFACTURING METHOD

[76] Inventor: Jean Posson, La Source-Route de Cholet, Trementines, France, 49340

[21] Appl. No.: 08/256,901

[22] PCT Filed: Feb. 10, 1993

[86] PCT No.: PCT/FR93/00139

§ 371 Date: Aug. 5, 1994

§ 102(e) Date: Aug. 5, 1994

[87] PCT Pub. No.: WO93/15962

PCT Pub. Date: Aug. 19, 1993

[30] Foreign Application Priority Data

Feb. 11, 1992 [FR] France ..... 92 01779

[51] Int. Cl.[6] ..... B65D 5/20

[52] U.S. Cl. ..... 229/186; 229/5.84; 493/130; 493/151

[58] Field of Search ..... 229/186, 187, 229/189, 182.1, 3.1, 5.84; 493/126, 127, 130, 147, 151

[56] References Cited

U.S. PATENT DOCUMENTS

| | | | |
|---|---|---|---|
| 1,959,613 | 5/1934 | Carson . | |
| 2,150,443 | 3/1939 | Hoag | 229/186 |
| 2,336,494 | 12/1943 | Metcalf | 229/186 |
| 2,637,483 | 5/1953 | Shapiro | 229/186 |
| 3,146,933 | 9/1964 | Moore | 229/186 X |
| 3,454,209 | 7/1969 | Persson | 229/186 |
| 3,545,665 | 12/1970 | Nimoroff | 229/186 X |
| 3,812,641 | 5/1974 | Bemiss | 229/186 X |
| 4,014,496 | 3/1977 | Christensson | 229/186 X |
| 4,189,088 | 2/1980 | Rappolt et al. | 229/186 |
| 4,304,352 | 12/1981 | Humphries . | |
| 4,722,474 | 2/1988 | Dropsy | 229/3.1 |
| 4,832,257 | 5/1989 | Wood | 229/186 |
| 5,009,939 | 4/1991 | Goldberg | 229/3.1 |
| 5,297,726 | 3/1994 | Detzel | 229/186 |

FOREIGN PATENT DOCUMENTS

| | | | |
|---|---|---|---|
| 672557 | 10/1963 | Canada | 229/186 |
| 0178730 | 4/1986 | European Pat. Off. . | |
| 0178730-B1 | 8/1989 | European Pat. Off. . | |

*Primary Examiner*—Stephen P. Garbe
*Attorney, Agent, or Firm*—Greenblum & Bernstein P.L.C.

[57] ABSTRACT

Fluid-tight, boat-shaped packaging tray comprises a bottom surrounded by sides, connected in pairs by means of inwardly backfolded bellows. These bellows comprise two portions which contact one of the sides. The first portion of the bellows, adjacent to the side contacting the bellows, has an upper cut-out portion which provides for direct contact between the second portion of the bellows and the side of the packaging tray which contacts the bellows during fabrication. The fabrication provides a method whereby simple gluing of the internal faces of the sides intended to contact the bellows allows the front face of one of the portions to be assembled with the back face of the other portion in order to facilitate erection and assembly of container and to maintain the fluid-tight nature of the corner. This assembly method requires the application of adhesive to only one side of the cardboard blank from which the packaging tray is formed, and the resultant structure prevents liquid from rising by capillary action and provides an attractive external appearance of the packaging tray.

51 Claims, 4 Drawing Sheets

LIQUID-TIGHT BOAT-SHAPED PACKAGING TRAY AND ITS MANUFACTURING METHOD

BACKGROUND OF THE INVENTION

1. Field of the Invention

This invention relates to the field of packaging and concerns more particularly a liquid-tight cardboard tray produced from a suitable cardboard blank and the process by which the blank is assembled.

2. Description of Related Art

Some food products, such as the meat of poultry, steak or liver, are usually packed in packaging in the form of trays associated with a protective plastic film.

These trays are generally made from a polystyrene type material, and although relatively cheap to produce, they do have the drawback of not being biodegradable or recyclable.

To overcome these drawbacks, cardboard trays have been suggested comprising a bottom that is generally rectangular and comprises four sides. Sealing at the corners is ensured by bellows which are folded back against one of the lateral walls and held in position by gluing.

These bellows are produced in two generally triangular portions. To maintain the volume of the tray, one of these portions is glued on the back and the other on the front, depending on whether they are positioned inside or outside of the tray.

This double application of glue complicates automatic assembly of the trays, the complexity involved calling for the use of bulky assembly machines and limiting the speed at which the trays can be assembled.

A liquid-tight cardboard container is described in document U.S. Pat. No. 1,959,613. Its corners are provided with bellows in two portions, one of which comprises an opening or cut-out allowing the other portion of the bellows to come into direct contact with the receiving side. Thanks to this feature, the volume of the packaging can be maintained by applying glue to only one side of the cardboard blank.

In this container, the bellows are folded back against the outside to avoid the presence of internal folds and to keep the cut edges of the blank that are likely to absorb liquid outside the internal volume. Given the leak-proof end use of this container, for packaging liquids for example, it is indispensable for the bellows to be positioned on the outside.

However, in relation to the assembly process of the packaging, particularly the application of glue to only one face of the blank, this structure cannot prevent liquid from seeping between the two portions of the bellows. Liquid is also able to rise up by capillary action and pass quickly into the heart of the cardboard via the upper cut edge, thus causing the component material to break, the packaging to sag and its contents to drain away. The presence of external bellows also makes this type of packaging unattractive.

Document U.S. Pat. No. 4,304,352 describes a similar structure in which the drawbacks of the above-mentioned container, particularly liquid seepage between the two portions of the bellows and the rising of said liquid by capillary action, are overcome by providing for recto-verso gluing.

In this leak-proof container, intended for packaging liquid or semi-liquid products, the upper cut-out provided in one of the portions of the bellows allows the other portion of the bellows to be glued on to the reception side in order to improve the strength of the corners. It also facilitates the assembly of the corners, in conjunction with the presence of an edge to receive a sealed cover.

In view of the intended use of this container, and for the reasons explained above in connection with document U.S. Pat. No. 1,959,613, its corner bellows have to be folded back against the outside of the container, Such a structure is not very attractive and limits the possibilities of applying exterior markings.

In addition, the recto-verso gluing of bellows makes for a particularly complicated assembly installation. The leak-proof containers described in documents U.S. Pat. Nos. 1,995,613 and 4,304,352 have very specific end uses that are different from those that are the object of the present invention. They are in fact adapted to packaging liquid products and must be associated with an occultation system in the form of a cover to retain the packaged product.

SUMMARY OF THE INVENTION

The cardboard tray that is the object of this invention is intended for the packaging of food products of the types such as chicken breast, steak or any other food products likely to exude small amounts of liquid. The object of this tray is to contain these small amounts of liquid, and it therefore comprises sealing properties, particularly at the corners of the bottom, adapted to stop liquid rising by capillary action. It is also very simple to produce and can be assembled by automatic means at very high speeds.

The sealed tray of the invention is produced from a cardboard blank comprising a bottom surrounded by sides connected in pairs in the corners by bellows in two portions. These bellows are folded back inside the tray against one of the sides. The first portion of the bellows, adjacent to the side receiving said bellows, comprises a cut-out in its upper portion. This cut-out allows the second portion of the bellows and the side that receives it to come into direct contact at the time of assembly.

The volume of the tray is maintained by applying glue to the internal surfaces of the sides that receive the bellows. This application of glue is adapted to rigidly bond together one of the faces of the first portion of the bellows in the lower zone of the corresponding side with the other face of the second portion in the upper zone of this side, at the same time avoiding or stopping the possibility of liquid rising by capillary action.

This tray structure calls for glue to be applied in adapted zones of only one side of the cardboard blank, and thus allows relatively simple automatic assembly lines to be used.

In addition, gluing the folded-back bellows to the inside of the tray produces rigid locking at the corners that prevents liquids from rising up by capillary action to the cut edges of the cardboard blank at the upper cut-out made in one of the portions of the bellows, or at the upper edge of the tray.

Glue can in fact be applied to the whole of the surface of the side that receives the bellows. In this case the whole surface of the portion of the bellows containing the upper cut-out is rigidly locked on the corresponding side and the small amount of liquid likely to stagnate in the bottom of the tray is unable to find any juxtaposition of walls which would allow it to rise by capillary action.

According to another embodiment, gluing is performed by applying two spots of glue. The first spot of glue is applied on the transition line between the two portions of the bellows pressed against their receiving side, and the second in the upper portion to ensure rigid locking of the portion of the bellows that does not have a cut-out. In this particular embodiment, the first glue spot blocks or stops any possible rising of the liquid by capillary action and prevents this liquid from reaching the cut edges of the tray.

The tray structure of the present application with bellows folded back on the inside also gives an impeccable external appearance to the finished product and allows advertising to be printed on a smooth, even surface.

BRIEF DESCRIPTION OF THE DRAWINGS

The invention will be better understood and other advantages and characteristics revealed from the following description of a number of embodiments of the invention. These should be read in conjunction with the accompanying drawings. In these drawings.

DETAILED DESCRIPTION OF THE INVENTION

Figure 1:
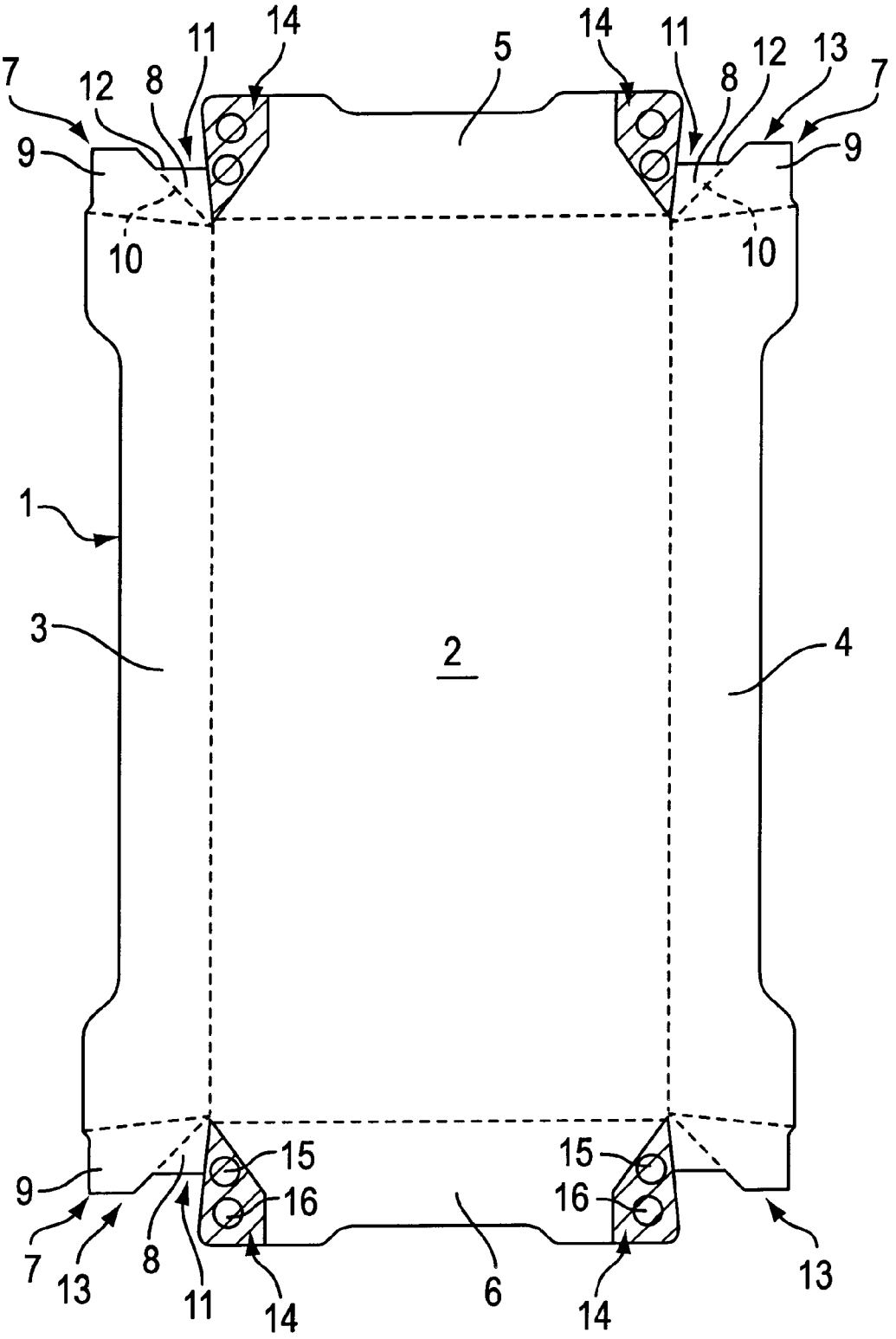
FIG. 1 shows a possible form of the cardboard blank from which the liquid-tight tray of the invention can be produced.
Figure 6:
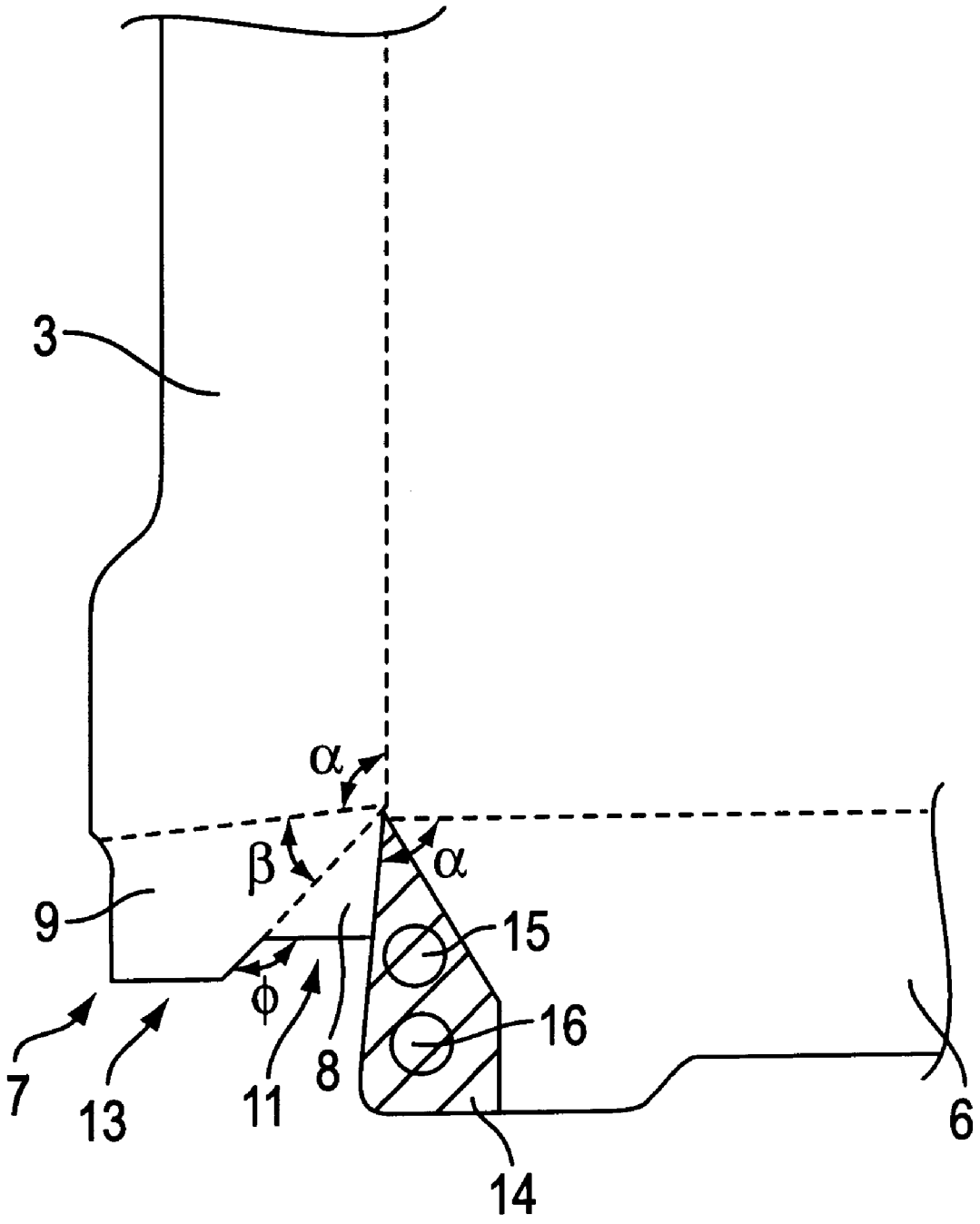
FIG. 6 is an enlarged partial view of the cardboard blank of FIG. 1, showing in detail one of the corners thereof.

FIG. 1 is a flat view of a cardboard blank that can be assembled to form a liquid-tight tray. This blank 1 comprises a rectangular bottom 2 surrounded by two large sides 3, 4 and two small end sides 5 and 6, said large sides and said end sides all being approximately the same height. Sides 3, 4, 5 and 6 are substantially trapezoidal in shape in order to provide a truncated-pyramid shaped tray. As such, as shown in FIG. 6, the interior angle $\alpha$ of each of sides 3 and 6, e.g., is greater than 90°. Said sides are connected in pairs by corner bellows 7 which are intended to provide sealing in at least the bottom of the tray and adapted to stop liquid rising by capillary action.

The four bellows 7 are identical and each comprises two portions 8 and 9 of a generally triangular shape, separated by a median folding line 10. Since interior angle $\alpha$ of each of the adjacent sides 5, 6 is greater than 90°, and the bottom 2 is rectangular, as mentioned above, the sum of the adjacent interior angles $\beta$ of each of the generally triangular portions 8, 9 is less than 90°, each angle $\beta$ being less than 45°. These angle values ensure the aforementioned truncated-pyramid shape of the tray, enabling a plurality of trays to be conveniently stacked after the sides are erected and glued together, as explained below. Obviously, if both angles $\alpha$ were 90° and the sum of the interior angles $\beta$ of portions 8 and 9 were likewise 90°, the blank, when erected, would form a generally parallelepipedic shape.

The first portion 8 of the bellows 7 is adjacent to the corresponding small side 5 or 6. It extends from bottom 2 to a height less than that of adjacent side 5, 6, so as to form an opening or cut-out 11 in its upper portion. As shown in FIG. 1, upper edge 12 of triangle 8 extends substantially perpendicular to the edge of the adjacent side, starting from half the height of this side. To retain satisfactory sealing in the bottom of the tray and allow automatic assembly, a minimum height of approximately 1 cm is retained for this portion 8 of the bellows.

The second portion 9 of bellows 7 is adjacent to the corresponding large side 3, 4. It extends substantially over the entire height of said large side. Its free corner 13, adjacent to cut-out 11 is truncated to avoid having to handle a piece of cardboard whose corners are too sharp.

The internal face, at least, of blank 1 has been treated so as to be impermeable, thus removing or at least limiting the penetration of moisture originating from the packaged products into the heart of the cardboard.

The tray is assembled in automatic fashion by appropriate automatic means.

This assembly is effected by folding back portions 8 and 9 of bellows 7 against the. internal faces of either small sides 5, 6 or large sides 3, 4, depending on the case. This choice depends on the dimensions of the tray and according to the techniques used if it is covered with stretchable plastic film. In the present case, bellows 7 are folded back against the internal faces of small sides 5 and 6.

The presence of the bellows inside the tray makes for a quality appearance, and does not interfere with stacking the products one inside the other providing conicity is provided (to be determined according to the final result required). It is also possible to print external markings (advertizing, decoration, information, etc.) on a smooth, even surface.

Figure 7:
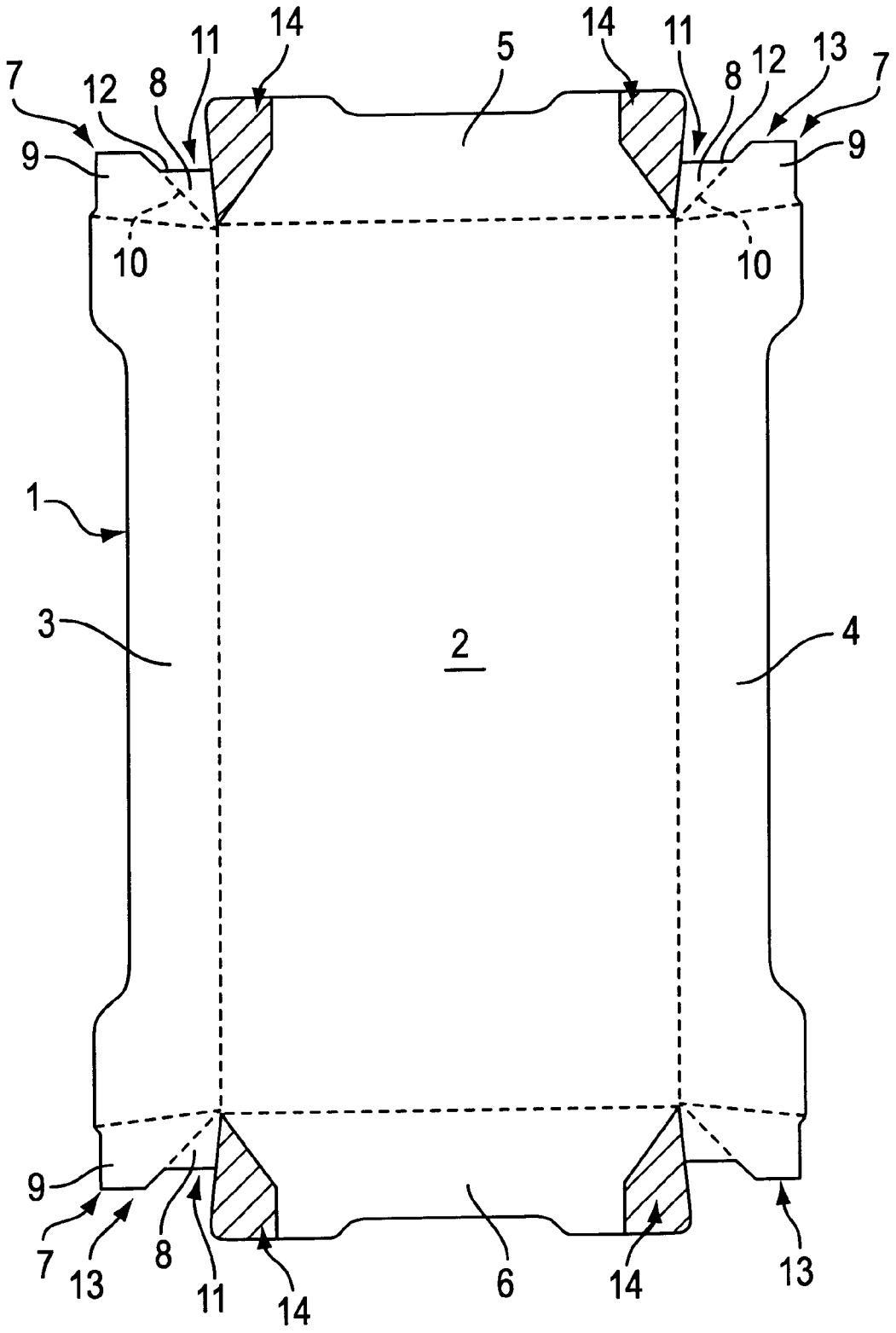
FIG. 7 shows another embodiment where all corners are glued by covering the entire glue application area.

The first stage of the assembly consists in applying glue to the side zones of the internal face of small sides 5 and 6 against which the two portions 8 and 9 of the bellows will be pressed. The glue can be applied either over the whole of cross-hatched surface 14 shown in FIG. 7, or in the form of carefully placed spots of glue as will be described hereinafter.

Figure 2:
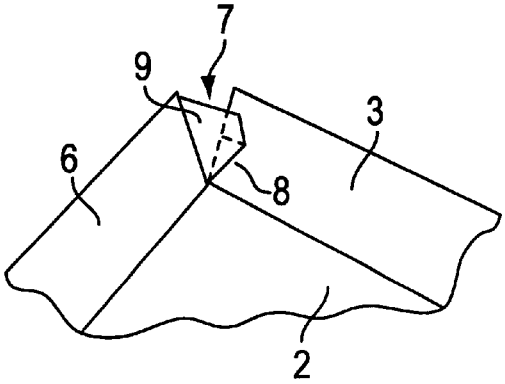
FIGS. 2, 3 and 4 are perspective views of a corner of the tray during assembly.
Figure 3:
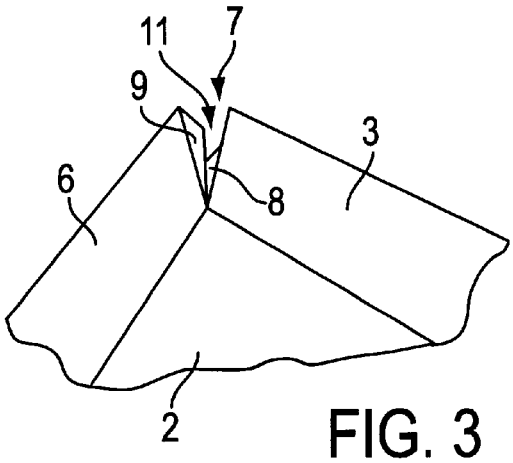
Figure 4:
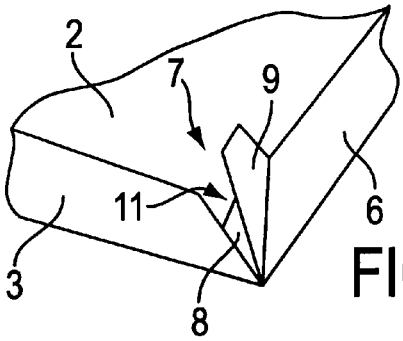
Figure 5:
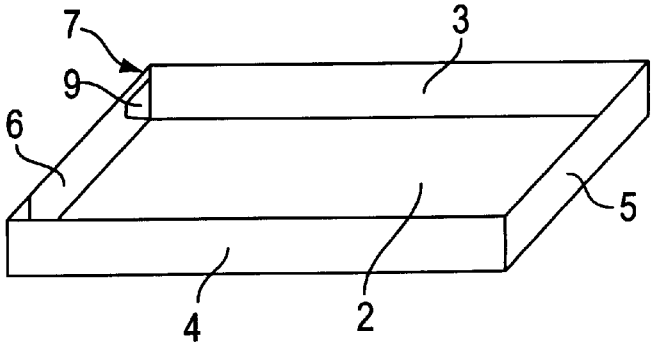
FIG. 5 is a perspective view of the tray of the invention after assembly.

As shown in FIGS. 2 to 4, the following stage consists in lifting up sides 3, 4, 5 and 6 and pressing the two portions 8 and 9 of corner bellows 7 against the receiving side 5, 6. As a result of this operation, the front side of the first portion 8 of the bellows is pressed against the lower glue application zone. Moreover, thanks to the presence of cut-out 11, the back side of second portion 9 of the bellows is pressed against the upper glue application zone. By means of the configuration of the cut-out 11 and upper edge 12 of the first portion 8 of the bellows 7, it can be seen particularly in FIG. 1 that a significant portion of the surface area of the second portion 9 of bellows 7, i.e., more than one-half, is available for being secured to the adhesive or glue application zone 14. In addition, the free corner 13 of the second portion 9 of the bellows extends beyond the upper edge 12 of the first portion 8, the free corner 13 of the second portion 9 thereby having an edge which forms an angle $\phi$ with edge 12, as shown in FIG. 6. Since the free corner 13 extends beyond the upper edge 12, as shown, the angle $\phi$ is less than 180°.

In a preferred embodiment shown in FIG. 1, the glue is applied in the form of two spots of glue 15 and 16, vertically aligned on glue application zone 14. Spot of glue 15 is placed at the level of upper edge 12 of first portion 8 of the bellows. It blocks the transition line between this first portion 8 and second portion 9 of the bellows. Moreover, it prevents moisture from rising by capillary action. The second spot of glue 16 is placed in the upper portion. It rigidly locks the internal face of small side 5, 6 against second portion 9 of the bellows. Depending on the height of the tray, additional spots of glue can be added. Note also that glue can be applied by pad to obtain a larger gluing area.

Glue is applied to only one side of the blank, and is followed by a very fast and simple assembly stage that can be carried out at very high speed.

The specific assembly procedure results in correct locking at the corners and good sealing of bellows at the bottom of the tray.

In a further embodiment, it is possible to remove the fold line provided between second portion 9 of the bellows and adjacent side 3, 4. This embodiment makes it possible to produce a tray with less sharp, slightly rounded corners.

The truncated-pyramid shape of the tray, whereby the sides 3, 4, 5 and 6 flare upwardly and outwardly from the bottom 2, facilitates the stacking of empty trays. This shape can of course be varied while retaining the same structure and assembly principle.

Indeed, the sides of the tray can be perpendicular to the bottom, with angles $\alpha$ being 90°, so as to form a packaging tray in the form of a parallelepiped. Moreover the bottom 2 may have any polygonal form.

In addition, cut-out 11, made in the upper zone of one of the portions of the bellows, can be made by any appropriate means and presented in any shape.

I claim:

1. A fluid-tight, boat-shaped packaging tray, comprising:

a bottom comprising an internal face, surrounded by sides, each side comprising an internal face, connected in pairs by bellows;

each of said bellows comprising first and second portions, said second portion having a predetermined surface area which is bordered by one of said sides and by said first portion of the bellows;

said first portion of said bellows comprising an upper, cut-out portion defined by an upper edge extending from said second portion of said bellows to a respective adjacent one of said sides;

said bellows being folded inwardly and rigidly locked against a corresponding internal face of a corresponding side by an adhesive located at and above said upper edge of said first portion of said bellows, such that said bellows is capable of preventing or stopping liquid contained in said packaging tray from rising by capillary action; and said upper edge of said first portion of said bellows extending to said adjacent one of said sides at a position for enabling a majority of said predetermined surface area of said second portion of said bellows to come into direct contact with the internal face of a corresponding side.

2. The fluid-tight packaging tray of claim 1, wherein said adhesive is disposed between an internal face of a side of the packaging tray and said second portion of said bellows to affix said second portion to said side, and wherein said adhesive is also disposed between said side of said packaging tray and said upper edge of said first portion of said bellows, so as to maintain said packaging tray in an assembled configuration.

3. The fluid-tight packaging tray of claim 2, wherein said adhesive comprises a plurality of separate spots.

4. The fluid-tight packaging tray of claim 1, wherein the second portion comprises a substantially planar member consisting of two major surfaces, and wherein the predetermined surface area comprises an entire surface area of one of the major surfaces.

5. The fluid-tight packaging tray of claim 1, wherein substantially all of said upper portion of said first portion is cut away.

6. The fluid-tight packaging tray of claim 5, wherein said first portion of said bellows has a height of at least one centimeter.

7. The fluid-tight packaging tray of claim 1, wherein said bellows extends over at least substantially one half of the height of said sides.

8. The fluid-tight packaging tray according to claim 1, wherein said bellows are folded back upon opposing sides of said packaging tray at the corners of the packaging tray.

9. The fluid-tight packaging tray of claim 1, wherein at least one of said internal faces of said bottom and sides is substantially fluid impermeable.

10. The fluid-tight packaging tray of claim 4, wherein said first and second portions of said bellows are separated by a median fold line.

11. The fluid-tight packaging tray of claim 1, further comprising a generally rectangular bottom, surrounded by four sides.

12. The fluid-tight packaging try of claim 11, comprising two large sides and two small sides.

13. The fluid-tight packaging tray of claim 1, wherein each of said sides has a respective predetermined height, and wherein said upper edge of said first portion of said bellows extends to a position at substantially one-half of said predetermined height of said adjacent one of said sides.

14. The fluid-tight packaging tray of claim 1, wherein said upper edge of said first portion of said bellows extends substantially perpendicularly to an edge of an adjacent one of said sides.

15. The fluid-tight packaging tray of claim 1, wherein said upper edge of said first portion of said bellows has a predetermined length extending from an edge of said second portion of said bellows to an edge of an adjacent one of said sides, and wherein said adhesive extends completely along and covers said predetermined length of said upper edge of said first portion of said bellows.

16. The fluid-tight packaging tray of claim 11, wherein said upper edge of said cut-out portion forms an angle of less than 180° with an edge of said second portion of said bellows.

17. The fluid-tight packaging tray of claim 1, wherein said first and said second portions of said bellows are separated by a median fold line along which said bellows are folded, said fold line forming, with an adjacent one of said sides, an interior angle, said interior angles of both of said first portion and said second portion of each of said bellows equalling a sum of less than 90°.

18. The packaging tray of claim 1, wherein said sides flare upwardly and outwardly from said bottom.

19. The fluid-tight packaging tray of claim 1, wherein said adhesive does not coat the entirety of said internal faces of said bottom and said sides.

20. A cardboard blank for producing a fluid-tight packaging tray, said blank comprising:

a bottom comprising an internal face, surrounded by sides, each side comprising an internal face, connected in pairs by bellows;

each of said bellows being foldable to contact a corresponding internal face of a respective one of said sides at a bellows-receiving area and comprising first and second portions, said second portion having a predetermined surface area which is bordered by one of said sides and by said first portion of the bellows;

said first portion of said bellows having an upper, cut-out portion defined by an upper edge extending from said second portion of said bellows to a respective adjacent one of said sides;

said upper edge of said first portion of said bellows extending to said adjacent one of said sides at a position for enabling a majority of said predetermined surface area of said second portion of said bellows to come into direct contact with the internal face of a corresponding side, upon erection and assembly of said blank to form said packaging tray; and an adhesive on the internal face of only one side of each of said pairs of sides of said blank at said bellows-receiving area and located at least at a location corresponding to said upper edge of said first portion of said bellows and above said location.

21. The cardboard blank of claim 20, wherein said adhesive is in the form of a plurality of separate spots on the internal face of said sides.

22. The cardboard blank of claim 20, wherein substantially all of said upper portion of said first portion of said bellows is cut away.

23. The cardboard blank of claim 20, where in said bellows extends over at least substantially one half of the height of said sides, upon assembly and erection of said packaging tray.

24. The cardboard blank of claim 20, wherein the second portion comprises a substantially planar member consisting of two major surfaces, and wherein the predetermined surface area comprises an entire surface area of one of the major surfaces.

25. The cardboard blank of claim 20, wherein each of said sides has a respective predetermined height, and wherein said upper edge of said first portion of said bellows extends to a position at substantially one-half of said predetermined height of said adjacent one of said sides.

26. The cardboard blank of claim 20, wherein said upper edge of said first portion of said bellows extends substantially perpendicularly to an edge of an adjacent one of said sides.

27. The cardboard blank of claim 20, wherein said adhesive does not coat the entirety of said internal faces of said bottom and said sides.

28. The cardboard blank of claim 20, wherein said upper edge of said first portion of said bellows has a predetermined length extending from an edge of said second portion of said bellows to an edge of an adjacent one of said sides, and wherein, upon said erection and assembly of said blank to form said packaging tray, said adhesive extends completely along and covers said predetermined length of said upper edge of said first portion of said bellows.

29. The cardboard blank of claim 20, wherein said upper edge of said cut-out portion forms an angle of less than 180° with an edge of said second portion of said bellows.

30. The cardboard blank of claim 20, wherein said first and said second portions of said bellows are separated by a median fold line along which said bellows are folded, said fold line forming, with an adjacent one of said sides, an interior angle, said interior angles of both of said first portion and said second portion of each of said bellows equalling a sum of less than 90°.

31. A process for manufacturing a fluid-tight packaging tray from a cardboard blank, said cardboard blank comprising a bottom comprising an internal face, surrounded by sides, the sides comprising internal faces, connected in pairs by bellows, the bellows comprising first and second portions, said second portion having a predetermined surface area which is bordered by one of said sides and by said first portion of the bellows, said first portion of said bellows comprising a cut-out portion defined by an upper edge extending from said second portion of said bellows to a respective adjacent one of said sides, each of said bellows being foldable to contact a corresponding internal face of a predetermined one of said sides at a bellows-receiving area;

the process comprising:

a) applying an adhesive to said bellows-receiving area at least corresponding to and above said upper edge of said first portion of said bellows;

b) erecting the sides of the packaging tray; and c) inwardly folding said first and second portions of said bellows so as to contact said bellows-receiving area, to affix said first portion of said bellows and a majority of said predetermined surface area of said second portion of said bellows through said cut-out portion to said bellows receiving area.

32. The process of claim 31, wherein step a) comprises applying a plurality of spots of adhesive comprising applying at least one spot of said adhesive between a side of the packaging tray and said upper portion of said second portion of said bellows, and at least one spot of adhesive between said side of said packaging tray and said upper edge of said first portion of said bellows, so as to form a block between said first and second portions of said bellows and to affix said second portion of said bellows to said side.

33. The process of claim 31, wherein the second portion comprises a substantially planar member consisting of two major surfaces, and wherein the predetermined surface area comprises an entire surface area of one of the major surfaces.

34. The process of claim 31, wherein the adhesive of step a) is applied to only the internal face of the sides of said blank.

35. The process of claim 31, wherein the adhesive of step a) is applied to substantially the entire area of said bellows-receiving area of said side of the packaging tray.

36. The process of claim 31, wherein each of said sides has a respective predetermined height, and wherein said upper edge of said first portion of said bellows extends to a position at substantially one-half of the height of said adjacent one of said sides.

37. The process of claim 31, wherein said upper edge of said first portion of said bellows extends substantially perpendicularly to an edge of an adjacent one of said sides.

38. The process of claim 31, wherein said step of applying an adhesive consists of applying adhesive to only a pair of opposite sides at respective ones of said bellows-receiving areas.

39. The process of claim 31, wherein said upper edge of said first portion of said bellows has a predetermined length extending from an edge of said second portion of said bellows to an edge of an adjacent one of said sides, and wherein, following said steps of applying an adhesive, erecting the sides, and inwardly folding said first and second portions of said bellows, said adhesive extends completely along and covers said predetermined length of said upper edge of said first portion of said bellows.

40. The process of claim 31, wherein said upper edge of said cut-out portion forms an angle of less than 180° with an edge of said second portion of said bellows.

41. The process of claim 31, wherein said step of inwardly folding said first and second portions of said bellows comprises inwardly folding said first and said second portions of said bellows along a median fold line, said fold line forming, with an adjacent one of said sides, an interior angle, said interior angles of both of said first portion and said second portion of each of said bellows equalling a sum of less than 90°.

42. The process of claim 31, wherein said step of erecting the sides of the packaging tray comprises erecting the sides so that they are positioned to flare upwardly and outwardly from the bottom.

43. A packaging tray comprising:

a bottom comprising an internal face, surrounded by sides, each side comprising an internal face, connected in pairs by bellows, each of said sides having a predetermined height, each of said bellows comprising first and second portions demarcated by a median fold line extending from a corner of said bottom;

said second portion having a predetermined surface area which is bordered by one of said sides and by said first portion of the bellows;

said first portion of said bellows having an upper, cut-out portion defined by an upper edge extending at an angle from an edge of said second portion of said bellows to a respective adjacent one of said sides at a position at substantially one-half of the predetermined height of said one of said sides, said second portion of said bellows thereby extending beyond said upper edge of said first portion of said bellows;

said bellows being folded inwardly along said median fold line and being rigidly locked against a corresponding internal face of a corresponding side by an adhesive located at and above said upper edge of said first portion of said bellows, such that said bellows is capable of preventing or stopping liquid contained in said packaging tray from rising by capillary action to said upper edge of said first portion of said bellows; and said cut-out portion of said first portion of said bellows allowing at least part of said second portion of said bellows to come into direct contact with the internal face of a corresponding side.

44. The packaging tray of claim 43, wherein the second portion comprises a substantially planar member consisting of two major surfaces, and wherein the predetermined surface area comprises an entire surface area of one of the major surfaces.

45. The packaging tray of claim 43, wherein said upper edge of said cut-out portion forms an angle of less than 180° with said edge of said second portion of said bellows.

46. The packaging tray of claim 43, wherein said median fold line forms, with an adjacent one of said sides, an interior angle, said interior angles of both of said first portion and said second portion of each of said bellows equalling a sum of less than 90°.

47. The packaging tray of claim 43, wherein said sides flare upwardly and outwardly from said bottom.

48. A fluid-tight, boat-shaped packaging tray, comprising:

a bottom comprising an internal face, surrounded by first and second sides, the first side being shorter than the second side, each side comprising an internal face, connected in pairs by bellows;

each of said bellows comprising first and second portions, said second portion having a predetermined surface area which is bordered bv one of said sides and by said first portion of the bellows;

said first portion of said bellows comprising an upper, cut-out portion defined by an upper edge extending from said second portion of said bellows to said first side;

said bellows being folded inwardly and rigidly locked against an internal face of said first side by an adhesive located at and above said upper edge of said first portion of said bellows, such that said bellows is capable of preventing or stopping liquid contained in said packaging tray from rising by capillary action;

said upper edge of said first portion of said bellows extending to said first side at a position for enabling a majority of said predetermined surface area of said second portion of said bellows to come into direct contact with the internal face of said first side; and said first and said second portions of said bellows being separated by a median fold line along which said bellows are folded, said fold line forming, with an adjacent one of said sides, an interior angle, said interior angles of both of said first portion and said second portion of each of said bellows equalling a sum of less than 90°, and each of said first and second sides being flared to form an angle between said bottom and said respective portions which is greater than 90°.

49. The fluid-tight, boat-shaped tray of claim 48, wherein the second portion comprises a substantially planar member consisting of two major surfaces, and wherein the predetermined surface area comprises an entire surface area of one of the major surfaces.

50. A process for manufacturing a fluid-tight packaging tray from a cardboard blank, said cardboard blank comprising a bottom comprising an internal face, surrounded by first and second sides, the first side being shorter than the second side, each side comprising an internal face, connected in pairs by bellows, said second portion having a predetermined surface area which is bordered by one of said sides and by said first portion of the bellows, said first portion of said bellows comprising an upper, cut-out portion defined by an upper edge extending from said second portion of said bellows to said first side, said first and said second portions of said bellows being separated by a median fold line along which said bellows are folded, said fold line forming, with an adjacent one of said sides, an interior angle, said interior angles of both of said first portion and said second portion of each of said bellows equalling a sum of less than 90°, said first and second sides being flared to form angles between said bottom and said respective portions which are greater than 90°, each of said bellows being foldable to contact the first and second portions of said bellows with the internal face of said first side at a bellows-receiving area, the process comprising:

a) applying an adhesive to said bellows-receiving area at least corresponding to and above said upper edge of said first portion of said bellows;

b) erecting the sides of the packaging tray; and c) inwardly folding said first and second portions of said bellows so as to contact said bellows-receiving area, to affix said first portion of said bellows and a majority of said predetermined surface area of said second portion of said bellows through said cut-out portion to said bellows receiving area.

51. The process of claim 50, wherein the second portion comprises a substantially planar member consisting of two major surfaces, and wherein the predetermined surface area comprises an entire surface area of one of the major surfaces.

* * * * *